US010062966B2

(12) United States Patent
Mangenot et al.

(10) Patent No.: US 10,062,966 B2
(45) Date of Patent: Aug. 28, 2018

(54) ARRAY ANTENNA HAVING A RADIATION PATTERN WITH A CONTROLLED ENVELOPE, AND METHOD OF MANUFACTURING IT

(75) Inventors: Cyril Mangenot, Wassenaar (NL); Giovanni Toso, Haarlem (NL); Carolina Tienda Herrero, Madrid (ES)

(73) Assignee: Agence Spatiale Europeenne, Paris (FR)

( * ) Notice: Subject to any disclaimer, the term of this patent is extended or adjusted under 35 U.S.C. 154(b) by 710 days.

(21) Appl. No.: 14/111,046

(22) PCT Filed: Apr. 12, 2011

(86) PCT No.: PCT/IB2011/051583

§ 371 (c)(1),
(2), (4) Date: Dec. 23, 2013

(87) PCT Pub. No.: WO2012/140471

PCT Pub. Date: Oct. 18, 2012

(65) Prior Publication Data

US 2014/0104107 A1 Apr. 17, 2014

(51) Int. Cl.
*H01Q 3/36* (2006.01)
*H01P 11/00* (2006.01)
(Continued)

(52) U.S. Cl.
CPC ..... *H01Q 3/36* (2013.01); *H01P 11/00* (2013.01); *H01Q 3/26* (2013.01); *H01Q 21/22* (2013.01); *Y10T 29/49016* (2015.01)

(58) Field of Classification Search
CPC . H01P 11/00; H01Q 3/26; H01Q 3/30; H01Q 3/34; H01Q 3/36; H01Q 21/06;
(Continued)

(56) References Cited

U.S. PATENT DOCUMENTS 4,052,723 A * 10/1977 Miller ..... H01Q 3/34 342/368
4,532,519 A * 7/1985 Rudish et al. ..... H01Q 3/34
(Continued)

FOREIGN PATENT DOCUMENTS

EP 2 090 995 A1 8/2009

OTHER PUBLICATIONS

Angeletti, P., et al.; "*A combined Amplitude-Density Synthesis Approach for the design of Linear Aperiodic Arrays*;" 2010 IEEE International Symposium on Phased Array Systems and Technology; dated 2010; pp. 719-723.

(Continued)

*Primary Examiner* — Bernarr E Gregory
(74) *Attorney, Agent, or Firm* — Alston & Bird LLP

(57) ABSTRACT

A method for manufacturing an array antenna having a design phase, including synthesizing an array layout of the array antenna and choosing or designing radiating elements to be arranged according to the array layout; and a phase of physically making the array antenna, including arranging the radiating elements according to the array layout; the design phase having the steps of: a) synthesizing an array layout complying with a required minimum beamwidth, a required field of view, a required side lobe level and a target angular dependence of the maximum directivity of the array antenna over the required field of view; b) determining shaped radiation patterns of the radiating elements in order to approximate said target angular dependence of the maximum directivity of the array antenna over the required field of view; and c) choosing or designing radiating elements having the shaped radiation patterns determined at step b).

15 Claims, 7 Drawing Sheets

(51) Int. Cl.

| | |
|---|---|
| ***H01Q 3/26*** | (2006.01) |
| ***H01Q 21/22*** | (2006.01) |
| *H01Q 3/00* | (2006.01) |

(58) Field of Classification Search

CPC ..... H01Q 21/22; H01Q 3/267; H01Q 1/12; H01Q 1/22; H01Q 1/24; H01Q 1/241; H01Q 1/242; H01Q 1/243; H01Q 1/36; H01Q 21/0087; H01Q 21/0093; H01Q 21/20; Y10T 29/49; Y10T 29/49002; Y10T 29/49016; G06F 17/50; G06F 17/5045; G06F 17/5068

USPC ..... 342/368–377; 343/700 R, 703, 700 MS; 29/600, 601

See application file for complete search history.

(56) References Cited

U.S. PATENT DOCUMENTS

| | | | | | |
|---|---|---|---|---|---|
| 5,008,680 | A * | 4/1991 | Willey | H01Q 3/26 | 342/372 |
| 5,017,928 | A * | 5/1991 | Haupt | H01Q 21/22 | 342/372 |
| 5,274,390 | A * | 12/1993 | Breakall | H01Q 11/10 | 343/792.5 |
| 5,434,576 | A | 7/1995 | Haupt | | |
| 5,537,367 | A * | 7/1996 | Lockwood | H01Q 21/22 | 342/372 |
| 6,351,243 | B1 * | 2/2002 | Derneryd | H01Q 3/26 | 343/700 MS |
| 6,404,404 | B1 * | 6/2002 | Chen | H01Q 21/22 | 343/844 |
| 6,456,244 | B1 * | 9/2002 | Goldstein | H01Q 3/26 | 343/700 MS |
| 7,466,287 | B1 * | 12/2008 | Lam | H01Q 21/22 | 343/700 MS |
| 7,522,095 | B1 * | 4/2009 | Wasiewicz et al. | H01Q 21/20 | |
| 7,797,816 | B2 | 9/2010 | Toso et al. | | |
| 8,191,231 | B2 * | 6/2012 | Lo | H01Q 1/243 | 343/700 MS |
| 8,279,118 | B2 * | 10/2012 | Snow | H01Q 3/26 | 342/372 |
| 8,326,586 | B2 * | 12/2012 | Noh | H01Q 1/36 | 343/700 MS |
| 8,330,662 | B2 * | 12/2012 | Mrstik | H01Q 3/267 | 343/703 |
| 2003/0076274 | A1 * | 4/2003 | Phelan | H01Q 21/0087 | 343/895 |

OTHER PUBLICATIONS

Bucci, O. M., et al.; "*Deterministic Synthesis of Uniform Amplitude Sparse Arrays via New Density Taper Techniques*;" IEEE Transactions on Antennas and Propagation, vol. 58, No. 6; pp. 1949-1958; dated Jun. 2010; retrieved on Jan. 9, 2014 from <http://www.lemma.unirc.it/tab_sint_ant/Articoli_1_3/Deterministic%20Synthesis%20of%2Uniform%20Amplitude%20Sparse%20Arrays%20via%20New%20Density%20Taper%20Techniques.pdf>.

Bucci, O. M., et al.; "*Optimal Synthesis of Directivity Constrained Pencil Beams by Mean of Circularly Symmetric Aperture Fields*;" IEEE Antennas and Wireless Propagation Letters, vol. 8; pp. 1386-1389; dated 2009.

Toso, G., et al.; "*Sparse and Thinned Arrays for Multiple Beam Satellite Applications*;" The 2nd European Conference on Antennas and Propagation; pp. 1-4; dated Nov. 2007; abstract retrieved on Jan. 9, 2014 from <http://ieeexplore.ieee.org/xpl/freeabs_all.jsp?arnumber=4458814&abstractAccess=no&userType=inst>.

Taylor, T. T.; "*Design of Circular Apertures forNnarrow Beamwidth and Low Sidelobes*;" IRE Transactions on Antennas and Propagation, vol. 8, No. 1; pp. 17-22; dated Jan. 1960; retrieved on Jan. 9, 2014 from <https://www.researchgate.net/publication/3444472_Design_of_circular_apertures_for_narrow_beamwidth_and_low_sidelobes>.

Viganò, M. C., et al.; "*Spatial density tapered sunflower antenna array*;" 3rd European Conference on Antennas and Propagation; pp. 778-782; dated Mar. 2009.

Viganò, M. C., et al.; "*Sunflower Array Antenna with Adjustable Density Taper*;" International Journal of Antennas and Propagation, vol. 2009;pp. 1-10; dated Jan. 5, 2009.

Yin, X. H., et al.; "*A simple design method of multimode horns*;" IEEE Transactions on Antennas and Propagation, vol. 53, No. 1; pp. 455-459; dated Jan. 2005; abstract retrieved on Jan. 9, 2014 from <http://ieeexplore.ieee.org/Xplore/defdeny.jsp url=http%3A%2F%2Fieeexplore.ieee.org%2Fstamp%2Fstamp.jsp%3Ftp%3D%26arnumber%3D1377622%26userType%3Dinst&denyReason=-133&arnumber=1377622&productsMatched=null&userType=inst>.

International Search Report and Written Opinion for Application No. PCT/IB2011/051583; dated Dec. 7, 2011.

* cited by examiner

ARRAY ANTENNA HAVING A RADIATION PATTERN WITH A CONTROLLED ENVELOPE, AND METHOD OF MANUFACTURING IT

FIELD

The invention relates to a method of manufacturing array antennas whose radiation pattern has a controlled envelope. The invention relates also to arrays antennas having controlled radiation patterns and suitable to be manufactured using said method.

The invention applies in particular to the manufacturing of aperiodic array antennas having an operational field of view larger than their minimum beamwidth. The invention applies more particularly to phased array antennas designed to scan a narrow beam over said operational field of view, to multibeam antennas generating several beams pointing in different directions in the same field of view or to phased array designed to generate a shaped beam.

The expression "array antenna" shall be interpreted broadly, encompassing all antennas characterized by a discretized aperture, including directly radiating arrays, radiating arrays illuminating a reflector, reflectarrays and discrete lenses.

The invention applies to both emitting and receiving antennas; in the transmitting case, the term "beam" will be used to indicate a main lobe of the transmitting radiation pattern, while in the receiving case, the term "beam" will be used to indicate a main lobe of the receiving radiation pattern. The invention applies to directly radiating array antennas, but also to arrays cooperating with reflector antennas, to discrete lens array antennas and to reflectarray antennas.

The invention is particularly suitable for, but not limited to, space applications related to telecommunications and/or remote sensing.

BACKGROUND

Active array antennas, implemented as Direct Radiating Array, in front of a reflector or in a discrete lens antenna, are characterized by high flexibility. However, their poor power efficiency, high cost and deployment complexity with respect to passive reflectors or passive array antennas have hindered their implementation in several applications and, in particular, in satellite missions. Today, active array antennas are employed in satellite applications mainly when antenna beam electronic reconfigurability is needed.

Recently, solutions based on aperiodic arrays with equi-amplitude or stepped amplitude elements have been considered in order to reduce the complexity and the cost of traditional periodic arrays when generating a multibeam coverage within an assigned limited field of view or a number of beams to be electronically steered within a limited field of view [1-5]. In fact, non regular filled apertures with equi-amplitude or stepped amplitude elements allow maximizing the Amplifiers Power Added Efficiency (in transmission); reducing the complexity and the required number of active controls; and reducing the sidelobes and grating lobes even using large average spacing between contiguous elements.

The achievable reduction in the number of radiators strongly depends on the requested sidelobe level and on the extension of the field of view where the pattern should be controlled [5]. Large non regular (aperiodic) arrays are characterized by inter-element distances exhibiting a large dynamic; as a consequence, in order to guarantee a good aperture efficiency, radiators with different dimensions should be employed. This means that small radiators may be used in the areas of the aperture where the inter-element distances are small, while larger elements may be used in areas characterized by large inter-element spacing. This increases the aperture efficiency, allowing a large fraction of the array surface contributing to the emission or reception of electromagnetic waves.

The design of non regular arrays is usually done considering only a single nominal pointing direction for the beam, frequently coinciding with the boresight direction. When the main beam is pointed out of this direction, severe scan losses are experienced especially because of the directive radiation patterns associated to the largest radiators composing the array. As a consequence, large non regular arrays characterized by a minimized number of controls exhibit scanning losses much higher compared to the cos θ-like scan losses typical of continuous apertures and densely populated arrays.

A similar problem arises with a multibeam pattern, comprising at least one beam pointing away from the boresight direction, and with shaped beams covering a broad field of view.

SUMMARY

The invention aims at decreasing the scan losses (and more generally the losses associated to beams pointing away from the boresight direction or beams having a broad coverage) in array antennas, and more particularly in sparsely-populated aperiodic array antennas. More generally, the invention aims at providing array antennas whose directivity has a tailored angular dependence over a given field of view. For the sake of the simplicity, the angular dependence of the antenna directivity will also be called the "envelope" of its radiation pattern.

An object of the invention, allowing achieving this aim, is a method for manufacturing an array antenna, comprising:

- a design phase, comprising synthesizing an array layout of said array antenna and choosing or designing radiating elements to be arranged according to said array layout; and
- a phase of physically making said array antenna, comprising arranging said radiating elements according to said array layout;

characterized in that said design phase comprises the steps of:

a) synthesizing an array layout complying with a required minimum beamwidth, a required field of view, a required side lobe level and a target angular dependence of the maximum directivity of the array antenna over said required field of view;

b) determining shaped radiation patterns of said radiating elements in order to approximate said target angular dependence of the maximum directivity of the array antenna over said required field of view; and c) choosing or designing radiating elements having the shaped radiation patterns determined at said step b).

The physical manufacturing step can be conventional.

Most prior art methods for synthesizing array antennas are based on the optimization of amplitude and phase excitation laws applied to the radiators without exploiting the degrees of freedom associated to the radiators patterns; instead, these degrees of freedom are exploited by the inventive method.

This is particularly advantageous when dealing with arrays composed by large radiators and even more when aperiodic arrays are implemented.

According to particular embodiments of the inventive method:

- Said steps a) and b) of said design phase can be performed jointly.
- Said step a) of said design phase can comprise synthesizing an aperiodic array layout.
- Said step c) of said design phase can comprise choosing or designing radiating elements having different sizes, the size of each radiating element being related to spacing from nearby elements.
- Each of said radiating elements can be chosen to belong to one among a plurality of subsets, each subset being constituted by radiating elements having a same radiation pattern, different from that of radiating elements belonging to different subsets.
- The shaped radiation patterns determined at step b) of said design phase can be such that their weighted average approximates said target angular dependence of the maximum directivity of the array antenna over said required field of view within a predetermined tolerance.
- More particularly, the shaped radiation patterns determined at said step b) of said design phase can approximate said target angular dependence of the maximum directivity of the array antenna over said required field of view within a predetermined tolerance.
- Said target angular dependence of the maximum directivity of the array antenna can be either flat over said required field of view, or increasing from the centre towards the edges of said required field of view.
- Said step c) of said design phase can comprise choosing or designing radiating elements at least some of which are sub-arrays constituted by a plurality of elementary radiating elements.

Another object of the invention is an array antenna comprising a plurality of radiating elements arranged according to an array layout, characterized in that said radiating elements have shaped radiation patterns whose weighted average is:

- either flat within 35% or less over a required field of view;
- or increasing from the center towards the edges of said required field of view;

said nominal field of view having a width of at least 5 times a minimum beamwidth determined by said array layout.

According to particular embodiments of the inventive antenna:

- Said radiating elements can have shaped radiation patterns which are themselves: either flat within 35% or less over said nominal field of view; or increasing from the center towards the edges of said nominal field of view.
- The antenna can further comprise a beam forming network for feeding the radiating elements, said beam forming network being adapted for: either scanning at least one beam over said required field of view; or generating a plurality of beam pointing at different directions of said required field of view; or generating a shaped beam covering said required field of view.
- Each of said radiating elements can belong to one among a plurality of subsets, each subset being constituted by radiating elements having a same radiation pattern, different from that of radiating elements belonging to different subsets.
- Said array layout can be aperiodic. Advantageously, the size of each radiating element can be related to spacing from nearby elements. In particular, said aperiodic array layout can form a sunflower lattice.
- At least some of said radiating elements can be sub-arrays constituted by a plurality of elementary radiating elements.

The expression "radiation pattern" refers to the relative amplitude of the radiated field in various directions from the antenna, at a constant distance. Because of the reciprocity properties of electromagnetic waves, the radiation pattern describes both the emission and reception characteristics of the antenna.

A "pencil beam" is the beam radiated by an aperture characterized by a uniform or, by extension, a real positive tapering.

A "shaped" radiation pattern, or shaped beam, can be defined as a radiation pattern corresponding to a non-uniform ("tapered") aperture excitation. In a more restricted sense, a "shaped" pattern can be defined as a radiation pattern corresponding to an aperture excitation with both amplitude and phase tapering.

The concept of "flatness" of a radiation pattern needs some clarification. A truly flat pattern would correspond to constant field amplitude over a predetermined field of view. A particularly interesting case of flat pattern is the "rectangular beam", characterized by zero amplitude outside said field of view. However, a perfectly rectangular beam cannot be synthesized, as it would require an infinitely large aperture. A real antenna, with a finite aperture, is only able to generate a beam approximating a rectangular shape. The degree of flatness—or of deviation from flatness—of a radiation pattern can be expressed by the ratio of the maximum ripple amplitude and the average value of the field intensity over a nominal field of view. An approximately flat pattern, as an arbitrarily shaped pattern, requires an aperture excitation with both amplitude and phase tapering.

The nominal field of view of the array antenna, used as a design parameter in the inventive manufacturing method, is usually "broad", in the sense that it has a half-cone width of at least 5 times, and preferably at least 10 times, that of the narrowest pencil beam which can be radiated by the whole array antenna.

"Width" means, in particular, half width at half maximum, or at −3 dB, of the radiation pattern.

BRIEF DESCRIPTION OF THE DRAWINGS

Additional features and advantages of the present invention will become apparent from the subsequent description, taken in conjunction with the accompanying drawings, which show.

DETAILED DESCRIPTION

Figure 1:
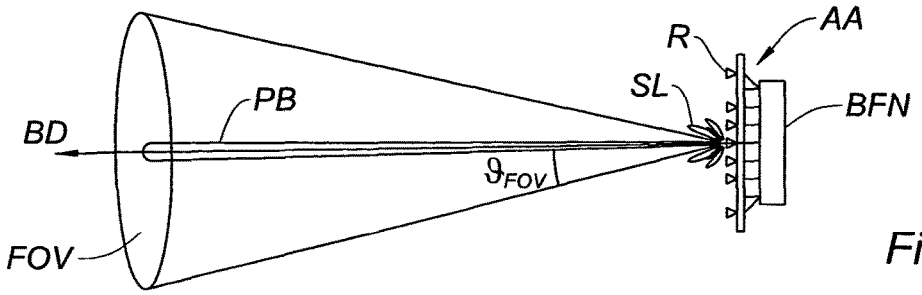
FIG. 1, a schematic representation of an array antenna illuminating a field of view.

FIG. 1 schematically represents an array antenna AA constituted by a plurality of radiating elements R (e.g. electromagnetic horns) arranged according to a predetermined layout over a (usually flat) surface of a supporting elements. Each radiating elements emits electromagnetic waves according to a specific radiation pattern; the electromagnetic waves emitted by all the radiating elements interfere to form an overall radiation pattern of the array antenna. The radiation pattern of the array antenna AA comprises a narrow (e.g. less than 1° at −3 dB) principal lobe, forming a "pencil beam" PB, and unavoidable sidelobes SL. The width, shape and orientation of the pencil beam can be modified by changing the amplitude and phase of the electromagnetic signals feeding the different radiating elements by a beam-forming network BFN. The BFN allows the pencil beam PB to be steered over a field of view FOV, assumed to have circular symmetry and be characterized by a limit angle $\theta_{FOV}$. The axis of symmetry of the field of view coincides with the direction perpendicular to the array, which is usually indicated as the "boresight" direction BD.

It is well known that an array antenna can also emit several beams at the same time and/or shaped beams, instead of a single pencil beam as in the non-limitative example of FIG. 1.

The Earth is seen from a geostationary (GEO) orbit within a cone characterized by an aperture angle of approximately 16° (8° of semi-aperture). Therefore obtaining a full Earth coverage requires an antenna able to scan a pencil beam up to about $\theta_{FOV}$=8° from its boresight direction. Even larger pointing angles may be necessary at lower orbits (LEO), or for antennas used on board mobiles and/or on ground. It is assumed that the required pencil beams should exhibit e.g. a −3 dB beamwidth smaller than 1°, for instance about 0.6° and that the required sidelobe level (SLL) should be sufficiently low compared to the beam peak, for instance −27 dB lower.

These requirements can be met, with a slight margin, using a circular continuous aperture with a diameter of 140 times the wavelength λ at the nominal central frequency, fed with a circular Taylor amplitude tapering characterized by an index n_bar=3 and a SLL of −27 dB/max (i.e. 27 dB below the maximum (see ref. [6]).

In order to replace the continuous aperture with a discrete array, the tapering can be sampled with a regular triangular lattice, which exhibits more favorable positions of the grating lobes as compared to a rectangular one. As an example, a spacing of 2λ guarantees avoiding grating lobes in a field of view of ±30°.

Figure 2A:
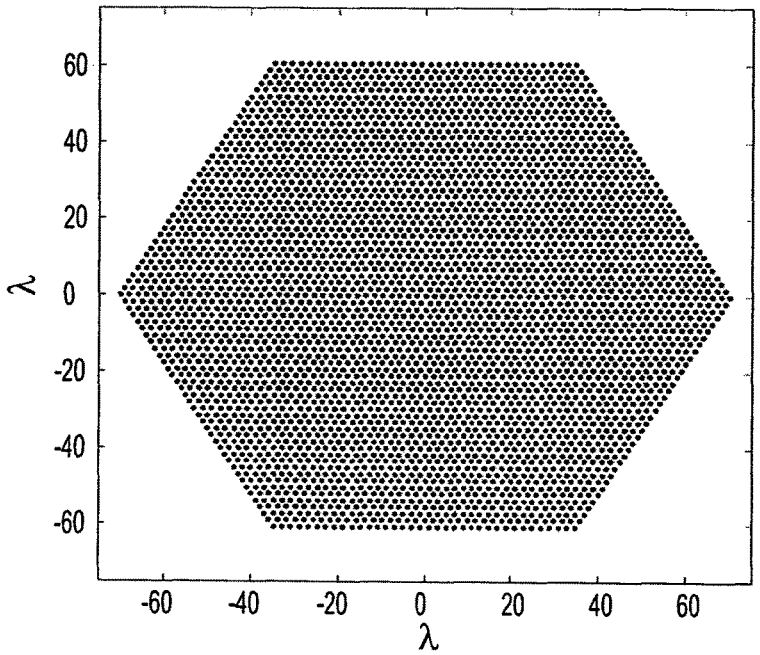
FIGS. 2A and 2B, the layout and the pattern of a dense, periodic phased array according to the prior art, suitable for scanning a pencil beam over a comparatively broad field of view or for performing multibeam coverage of an extended region of the Earth seen by space.
Figure 2B:
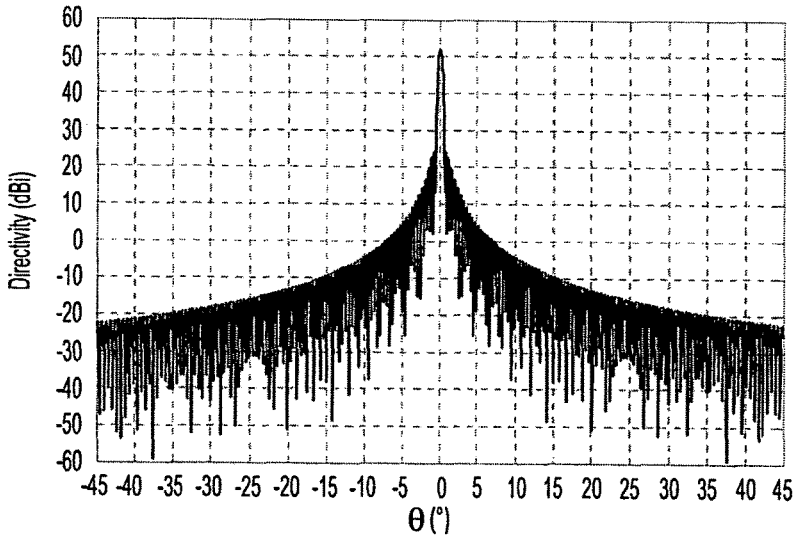

FIG. 2A shows the layout of such an array, having the shape of a hexagon inscribed in a circle of diameter D=140λ and characterized by an inter-element spacing of 2λ. Each radiating element is circular, with a 2λ diameter (i.e. the maximum value allowed by inter-element spacing) and a uniform excitation—i.e. the electric field is considered to be constant over the whole aperture of the element. The beam-forming network feeds the elements with a real and positive (i.e. amplitude-only) tapering obtained by sampling the continuous Taylor distribution illustrated in FIG. 2B.

Figure 3A:
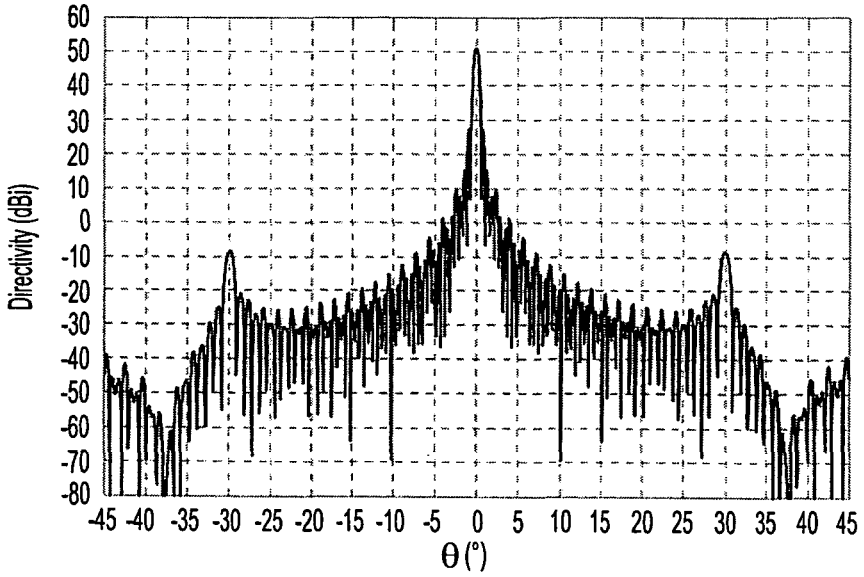
FIGS. 3A and 3B, plots of the directivity of the antenna of FIG. 1 for a beam pointing at 0° and 8°, respectively.
Figure 3B:
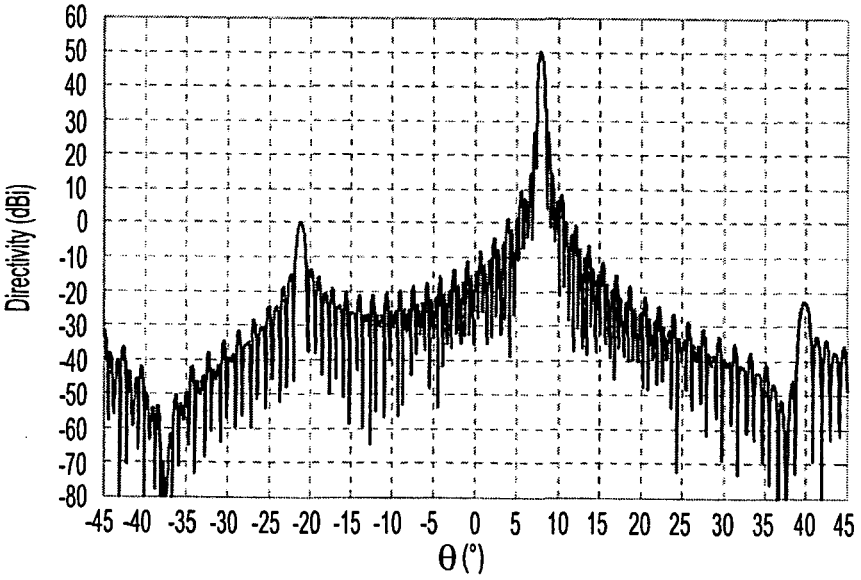

FIGS. 3A and 3B show the directivity diagrams (representations of the power patterns) of the array antenna of FIG. 2A pointing at θ=0° and at θ=8°, respectively; pointing of the beam is obtained by using variable phase shifters in the beam-forming network for adjusting the excitation phase of the radiating elements. It can be seen that the pencil beam (formed by the main lobe of the directivity diagrams) remains satisfactorily narrow, and the sidelobe level (SLL) sufficiently small, even at θ=8° from the boresight direction. The directivity, SLL and aperture efficiency of this antenna at θ=0°, 4° and 8° are given in the table below:

| θ = 0° | θ = 4° | θ = 8° |
|---|---|---|
| Maximum Directivity (dBi) | | |
| 51.16 | 50.98 | 50.31 |
| SLL (dB/max) | | |
| −23.84 | −23.81 | −23.64 |
| Aperture efficiency (%) | | |
| 67.6 | 64.86 | 55.59 |

It can be seen that the array antenna of FIG. 2A has very satisfactory performances; unfortunately, it is composed by 3781 elements, which is by far above all what can be considered for a realistic and competitive design.

Using a spacing of about 3.5λ instead of 2λ, a significant reduction in the number of elements may be achieved and the grating lobes would appear at an angle of about 16°, which is still sufficient for the application considered here. However, the number of radiators needed would remain prohibitive, higher than 2000. This is due to the large dimensions of the aperture (required to have a narrow beam) and by the angular extension of the desired field of view (±8° with respect to the boresight direction).

Figure 4:
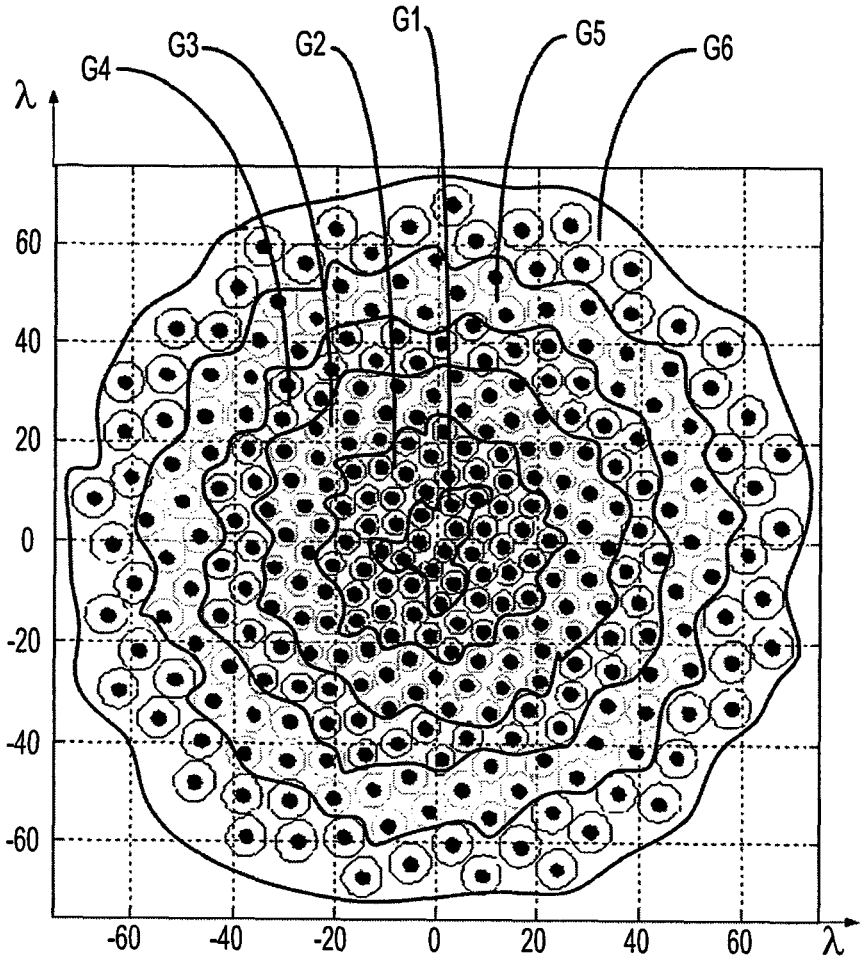
FIG. 4, the layout of an aperiodic "sunflower" array antenna, known from prior art.

The synthesis of aperiodic arrays gained a renewed interest during the last years, especially for the design of multibeam satellite antennas, as it is an effective way to drastically reduce the number of radiating elements. As an example, reference [4] describes an algorithm to design a "sunflower" array, wherein the radiating elements are placed in a lattice reproducing the positions of the sunflower seeds, smoothly distorted and adjusted in order to replace the desired amplitude tapering with a density-only tapering. FIG. 4 shows a sunflower lattice of 300 elements that corresponds to an aperture of 140λ diameter, fed with a circular Taylor distribution characterized by a SLL=−27 dB/max and n_bar=3, obtained using a suitable beam forming network.

This layout provides an improvement in the pattern avoiding the presence of high narrow grating lobes typical of periodic arrays. In order to optimize the aperture efficiency, the array is populated with circular apertures belonging to six subsets G1-G6 characterized by six different radii: $a_1$=2.25λ, $a_2$=2.5λ, $a_3$=2.75λ, $a_4$=3λ, $a_5$=3.5λ and $a_6$=4λ. These radii values are dictated by the inter-element spacing and are therefore smaller toward the array center and larger toward its periphery, in agreement with the selected circular Taylor tapering which is monotonically decreasing from the center to the rim of the aperture.

Figure 5A:
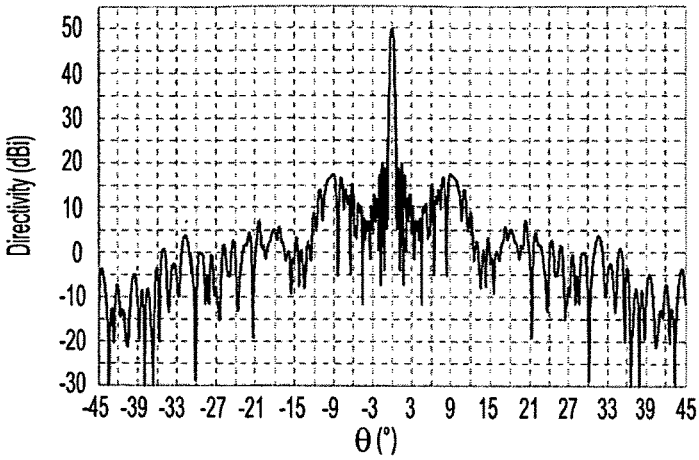
FIGS. 5A, 5B and 5C, plots of the directivity of the antenna of FIG. 4 for a beam pointing at 0° and 8°, and plots of the directivities of the different radiating elements of said antenna, respectively.
Figure 5B:
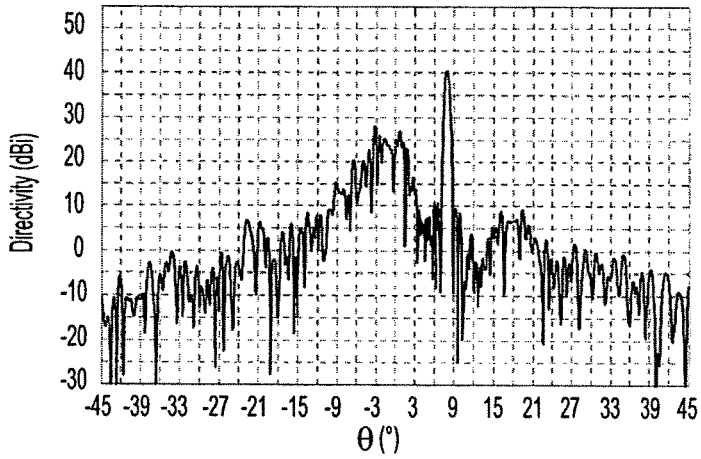

FIGS. 5A and 5B show the directivity diagrams of the array antenna of FIG. 4 pointing at θ=0° and at θ=8°, respectively; as in the case of FIGS. 3A and 3B, pointing of the beam is ensured by the beam-forming network. It can be easily seen that the antenna performances are very satisfactory when emitting in the boresight direction, and comply with the design requirement, but this is no longer true at θ=8°; the table below shows that at the end of coverage the SLL deteriorates by almost 20 dB and the aperture efficiency falls by nearly one order of magnitude.

| θ = 0° | θ = 4° | θ = 8° |
|---|---|---|
| Maximum Directivity (dBi) | | |
| 49.83 | 47.72 | 40.58 |
| SLL (dB/max) | | |
| −32.31 | −22.88 | −12.46 |
| Aperture efficiency (%) | | |
| 49.71 | 30.58 | 5.91 |

Figure 5C:
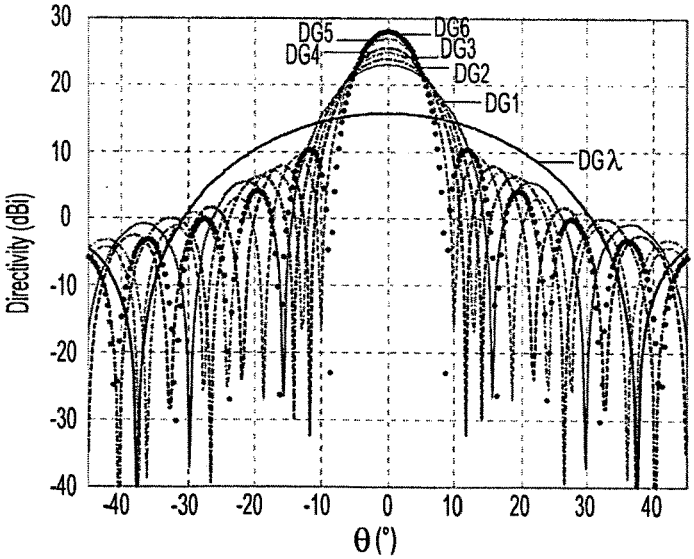

The poor performances of the "sunflower" array when pointing away from the boresight direction can be understood by studying the radiation patterns of the different radiating elements. They are illustrated in FIG. 5C, where DG1 is the directivity of the elements belonging to the group G1, having a radius $a_1$=2.25λ, DG2 is the directivity of the elements belonging to the group G2, having a radius $a_2$=2.5λ, DG3 is the directivity of the elements belonging to the group G3, having a radius $a_3$=2.75λ, DG4 is the directivity of the elements belonging to the group G4, having a radius $a_4$=3λ, DG5 is the directivity of the elements belonging to the group G5, having a radius $a_5$=3.5λ and DG6 is the directivity of the elements belonging to the group G6, having a radius $a_6$=4λ. The curve DGλ, corresponds to the directivity of an element of radius 1λ, like those used in the periodic array of FIG. 2A.

The "sunflower" layout allows a very significant reduction in the number of radiating elements while avoiding grating lobes. However, in order to preserve an acceptable level of aperture efficiency, the radiating elements must be larger as compared to the corresponding ones in a densely-populated periodic array such as that of FIG. 2A. Due to the well-known properties of Fourier transform, these larger radiating elements are more directive and have a narrower main beam and, as a consequence, the first nulls in their pattern are much closer to the beam pointing direction. This implies a drastic increase of the scanning losses, as illustrated in FIG. 5B.

One important idea at the basis of the invention is to compensate for this detrimental effect by exciting the radiating elements of an array antenna, and in particular of a sparse, aperiodic one (in the considered example, having a "sunflower" layout, but this is not essential) with a non-uniform taper.

Radiating elements can be sub-arrays constituted by a plurality of elementary radiating elements such as patch antennas or horns. In this case, the non-uniform taper can be obtained by feeding the elementary radiating elements through a suitably designed or configured beam forming network. This will be a preferred implementation for the largest radiating elements, such as those of subsets G5 and G6.

It is worth noting that document U.S. Pat. No. 5,434,576 teaches that sub-arrays with a non-uniform excitation can be used in array antennas to reduce the sidelobe level. This problem, however, is completely unrelated to that solved by the present invention. Moreover, document U.S. Pat. No. 5,434,576 only considers periodic array antennas, while the present invention is mostly (although not exclusively) directed to array antennas having an aperiodic layout.

Radiating elements can also be elementary antennas, and preferably aperture antennas such as horns connected with a waveguide. In this case, the non-uniform tapering can be obtained by a proper combination of the field associated to the guided modes, see e.g. reference [7].

In particular, the non-uniform taper of the radiating elements can be chosen to generate a "flat" radiation pattern over the desired field of view. For the sake of simplicity, only the case of circular radiating elements with a rotational symmetry will be considered here, but this is not essential.

A truly flat radiation pattern over a finite circular field of view can be obtained using a "Bessel" taper, i.e. a field distribution on the aperture of the radiating element expressed by a Bessel function of the first kind and order 1, normalized to its argument:

$$\frac{J_1\left(\frac{2\pi}{\lambda}\rho u_o\right)}{\frac{2\pi}{\lambda}\rho u_o}$$

where λ represents the wavelength, ρ the radial distance from the center of the radiating element and $u_0$ represents the sinus of the angle $\theta_{EOC}$ defining the "end of the coverage" ($u_0=\sin\theta_{EOC}$) i.e. the angle defining the end of the desired flat circular field of view. In the present case, $\theta_{EOC}=\theta_{FOV}$.

It will be easily understood that this ideal tapering is not physically implementable, as a Bessel function has tails extending to infinite. The easiest way to excite a finite aperture antenna generating a quasi flat radiation pattern over a finite circular field of view consists in truncating the infinitely long Bessel function at the edges of the radiating elements (i.e. for $\rho=a_i$, i=1-6 in the exemplary case of FIG. 3). This method is called Fourier method because it consists in using the truncated Fourier transform of the desired pattern to derive the excitation tapering. When applying the Fourier method for our circular aperture elements, the errors in approximating the ideal pattern with a circular flat shape depend on the effects of the neglected tails.

The conventional methods of pattern synthesis, such as the Fourier method, are not always adequate since the root-mean-square (r.m.s.) error criterion associated with them is not necessarily the most appropriate in many applications. In particular, for the application considered here, a better synthesis criterion may consist in minimizing the largest absolute deviation from the required pattern envelope.

As just mentioned the truncated Bessel function represents the tapering obtainable when using a Fourier method which guarantees the minimization of the average square error. In the following, a new tapering for the 6 different types of radiators populating the aperiodic sunflower array of FIG. 4, minimizing the average deviation from a nominal flat pattern, will be derived starting from a truncated Bessel function. Minimizing the deviation from an average value guarantees having beams pointing in different directions inside the antenna field of view with similar characteristics.

Two additional degrees of freedom can be used in deriving a modified tapering. The first is associated to the possibility of changing, inside the Bessel function, the parameter $\theta_{EOC}$ with respect to its nominal value equal to 8°. The second one consists in introducing, as a multiplicative factor for the Bessel tapering, a function decreasing smoothly from the center of the radiative elements towards their edges; in particular, a cosine to the power "q" function is selected. The analytical selected tapering is the following $$\frac{J_1\left(\frac{2\pi}{\lambda}\rho\sin\theta_{EOC}\right)}{\frac{2\pi}{\lambda}\rho\sin\theta_{EOC}}\cdot\cos^q(\rho)$$

The two variable and unknowns parameters, i.e. the $\theta_{EOC}$ appearing inside the Bessel function and the exponent "q" in the decreasing cosinusoidal function have been estimated adopting a quasi Newton algorithm imposing the constraint that the desired antenna pattern does not differ from its average value (evaluated in the same field of view) for more than 5%, 20%, 35%. The examples discussed below are based on such an optimized "tapered Bessel" excitation for the radiating elements of the array antennas.

It is important to note that modifying the two unknowns parameters, i.e. the $\theta_{EOC}$ in the Bessel function and the exponent "q" in the cosine function, permit to modulate the components, in sin θ, of the pattern. The cosine function represents one particular example of "window functions" which are well known in the design of F.I.R. filters. Other examples of windows for the design of filters, which can also be applied to the design of array antennas, are the Hann, Hamming, Blackman, Kaiser windows, which are well known in the fields of digital signal processing and of antenna engineering.

Figure 6A:
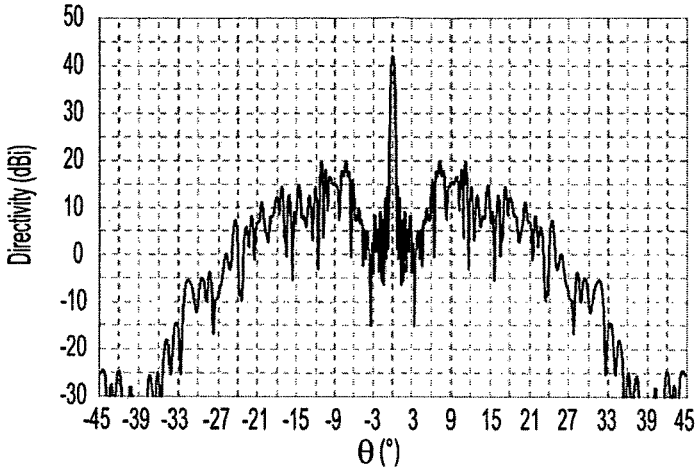
FIGS. 6A, 6B and 6C, plots of the directivity of an array antenna according to a first embodiment of the invention for a beam pointing at 0° and 8°, and plots of the directivities of the different radiating elements of said antenna, respectively.
Figure 6B:
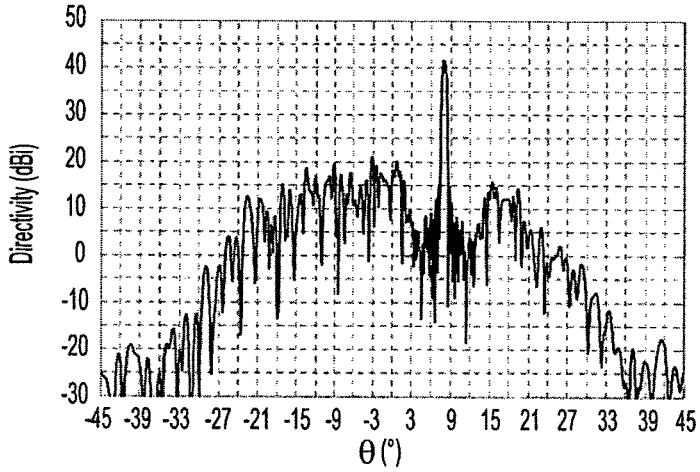

FIGS. 6A and 6B show the directivity diagrams of an array according to a first embodiment of the invention. The array is based on the "sunflower" layout of FIG. 4; the radiating elements are excited using a "tapered Bessel" profile, with $\theta_{EOC}$ values (one for each subset of elements) chosen to ensure a radiation power pattern which is flat within 5% with respect to its average value within a field of view of ±8° (otherwise stated: a threshold equal to 95% of the average value is imposed over the whole field of view):

| Subset | Aperture Radius (λ) | $\theta_{EOC}$ (°) | q |
|---|---|---|---|
| G1 | 2.25 | 23.5 | 0 |
| G2 | 2.5 | 22 | 0.85 |
| G3 | 2.75 | 21 | 0.95 |
| G4 | 3.0 | 20 | 0.95 |
| G5 | 3.5 | 18 | 1.15 |
| G6 | 4.0 | 17 | 1.2 |

Figure 6C:
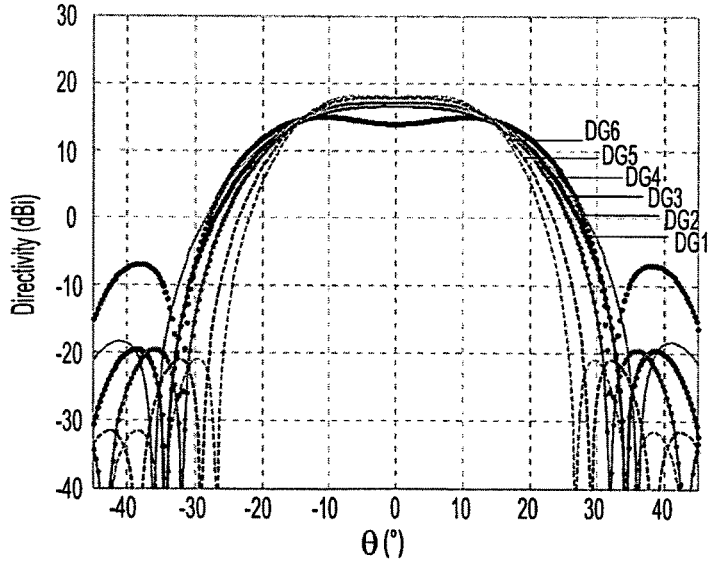

The directivities of the radiating elements of the different subsets are illustrated by curves DG1-DG6 on FIG. 6C.

It can be seen on FIGS. 6A and 6B that the use of radiating elements with tapered excitations avoids the dramatic loss of directivity and increase of the SLL for a main beam pointing at θ=8° which was observed in the case of a sunflower antenna with uniformly excited elements (FIGS. 5A and 5B). However, as shown by the table below, the directivity in the boresight direction decreases by 10 dB, the SLL at boresight deteriorates by approximately the same amount and the radiation efficiency is reduced to less than 10%. Otherwise stated, the reduction of the scanning losses comes at a price, which is the decrease of the performances in the boresight direction. It should also be noted that the beamwidth at −3 dB increases from 0.4° in the case of uniform excitation (FIGS. 5A and 5B) to 0.497° in the case considered here (FIGS. 6A and 6B).

| θ = 0° | θ = 4° | θ = 8° |
|---|---|---|
| Maximum Directivity (dBi) | | |
| 42.82 | 41.99 | 41.99 |
| SLL (dB/max) | | |
| −22.37 | −20.78 | −20.19 |
| Aperture efficiency (%) | | |
| 9.90 | 8.17 | 8.17 |

Figure 7A:
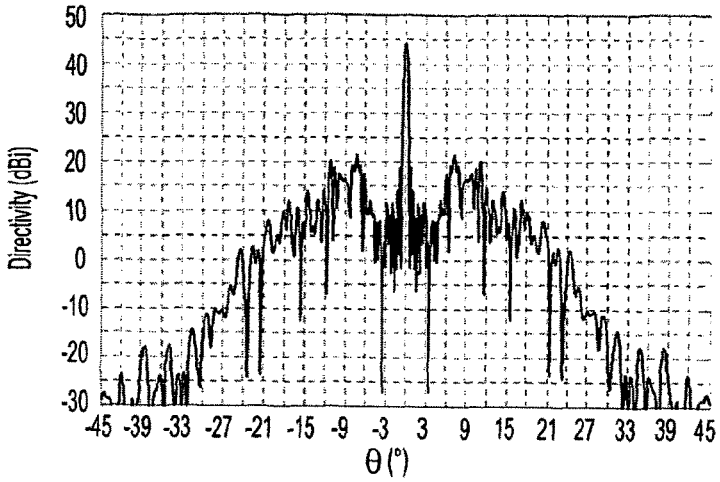
FIGS. 7A, 7B and 7C, plots of the directivity of an array antenna according to a second embodiment of the invention for a beam pointing at 0° and 8°, and plots of the directivities of the different radiating elements of said antenna, respectively.
Figure 7B:
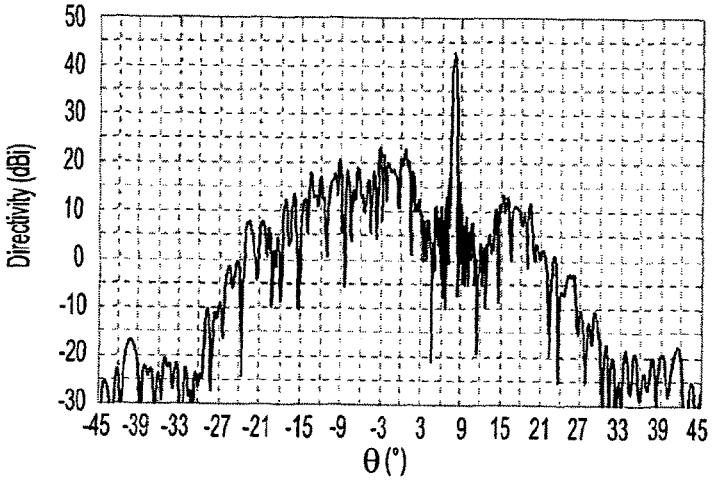
Figure 7C:
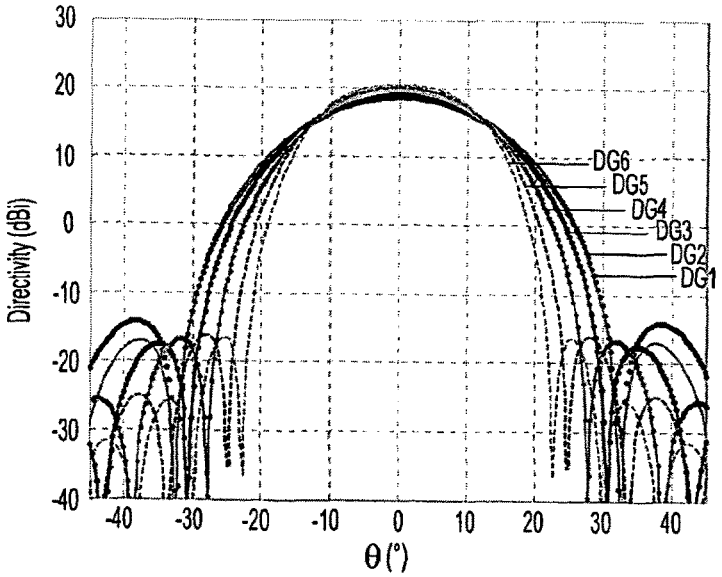

Depending on the specific application, a reduced flatness of the radiation pattern within the field of view can be traded off with increased aperture efficiency. For example, FIGS. 7A, 7B and 7C refer to a case wherein the flatness requirement of the radiating element power patterns has been relaxed by selecting a threshold equal to 80% with respect to their average value.

The excitation patterns of the radiating elements are defined by the following parameters:

| Subset | Aperture Radius (λ) | $\theta_{EOC}$ (°) | q |
|---|---|---|---|
| G1 | 2.25 | 19 | 0.5 |
| G2 | 2.5 | 18.5 | 0.85 |
| G3 | 2.75 | 17.5 | 0.95 |
| G4 | 3.0 | 16 | 0.95 |
| G5 | 3.5 | 15 | 0.95 |
| G6 | 4.0 | 14 | 1 |

and the antenna performances at θ=0°, θ=4° and θ=8° are:

| θ = 0° | θ = 4° | θ = 8° |
|---|---|---|
| Maximum Directivity (dBi) | | |
| 44.33 | 43.98 | 42.75 |
| SLL (dB/max) | | |
| −22.74 | −21.38 | −19.75 |
| Aperture efficiency (%) | | |
| 14.02 | 12.93 | 9.74 |

With respect to the previous case, there is an improvement of 1.51 dB in the directivity figure when the antenna is pointing at boresight and 0.76 dB when it is pointing at θ=8°.

Figure 8A:
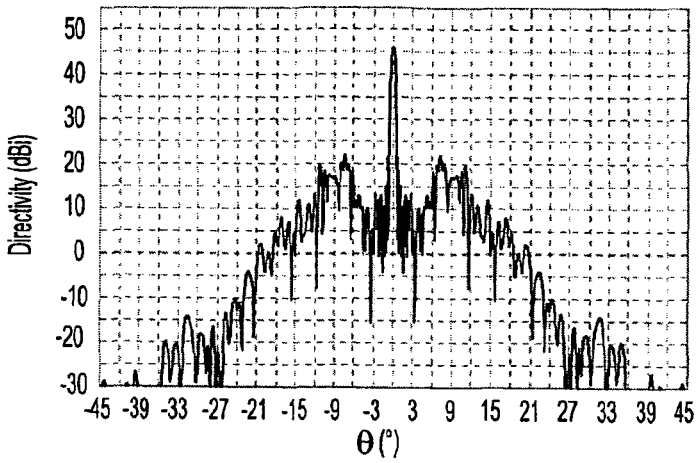
FIGS. 8A, 8B and 8C, plots of the directivity of an array antenna according to a third embodiment of the invention for a beam pointing at 0° and 8°, and plots of the directivities of the different radiating elements of said antenna, respectively.
Figure 8B:
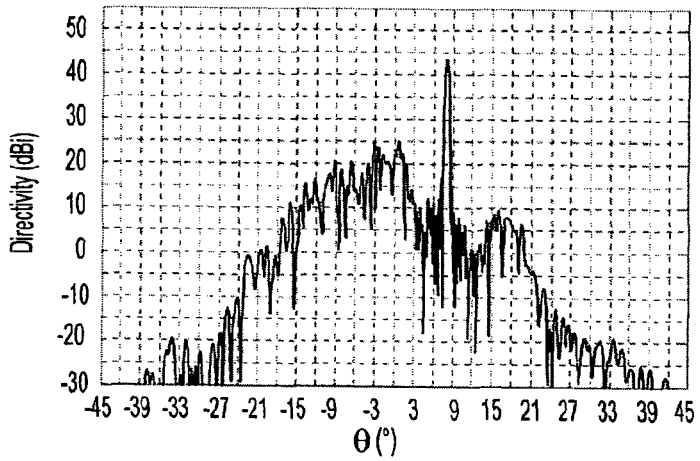
Figure 8C:
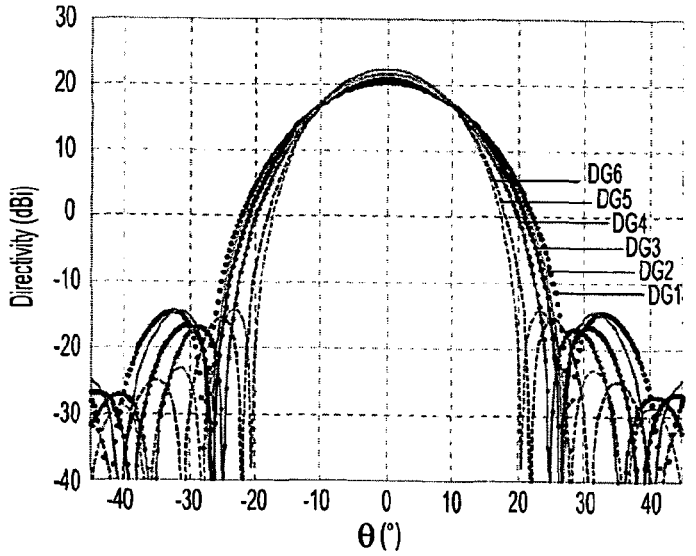

In the exemplary embodiment of FIGS. 8A, 8B and 8C the flatness requirements has been further lowered to 35% (threshold equal to 65% of the average value in the field of view). The excitation patterns of the radiating elements are defined by the following parameters:

| Subset | Aperture Radius (λ) | $\theta_{EOC}$ (°) | q |
|---|---|---|---|
| G1 | 2.25 | 15 | 0.55 |
| G2 | 2.5 | 14 | 0.85 |

-continued

| Subset | Aperture Radius (λ) | $\theta_{EOC}$ (°) | q |
|---|---|---|---|
| G3 | 2.75 | 13 | 0.95 |
| G4 | 3.0 | 12 | 0.95 |
| G5 | 3.5 | 12 | 0.95 |
| G6 | 4.0 | 11.5 | 1 |

and the antenna performances at θ=0°, θ=4° and θ=8° are:

| θ = 0° | θ = 4° | θ = 8° |
|---|---|---|
| Maximum Directivity (dBi) | | |
| 46.48 | 46.03 | 43.43 |
| SLL (dB/max) | | |
| −24.51 | −21.64 | −18.49 |
| Aperture efficiency (%) | | |
| 22.98 | 20.72 | 11.39 |

The following table presents a comparison of directivity, SLL and aperture efficiency for the spiral array with optimized elements using the three different optimization criteria considered here, i.e. threshold of 95%, 80% and 65%. It can be seen that, in the case of 65% threshold, the directivity increases by 3.5 dB with respect to the case of 95% threshold at θ=0° and by 1.4 dB at θ=+8°. The SLL worsens by 2.2 dB and the aperture efficiency improves by 13%.

| | θ = 0° | θ = +4° | θ = +8° |
|---|---|---|---|
| Maximum Directivity(dBi) | | | |
| threshold 95% | 42.82 | 41.99 | 41.99 |
| threshold 80% | 44.33 | 43.98 | 42.75 |
| threshold 65% | 46.48 | 46.03 | 43.43 |
| SLL (dB/max) | | | |
| threshold 95% | −22.37 | −20.78 | −20.19 |
| threshold 80% | −22.74 | −21.38 | −19.75 |
| threshold 65% | −24.51 | −21.64 | −18.49 |
| Aperture Efficiency (%) | | | |
| threshold 95% | 9.90 | 8.17 | 8.17 |
| threshold 80% | 14.02 | 12.93 | 9.74 |
| threshold 65% | 22.98 | 20.72 | 11.39 |

Comparing the different sub-arrays tapered distributions, one may notice that the use of radiating elements with non-uniform excitation allows a significant improvement of the array scanning performances. Moreover, depending on the specific excitation pattern which is chosen, it can be decided to emphasize flatness of the radiation pattern and low SLL at the expense of directivity at the boresight direction and of array efficiency, or to look for a more "balanced" solution.

The invention has been described with reference to a specific case, i.e. a directly-radiating phase array with a "sunflower" aperiodic layer, operating in transmission and generating a single pencil beam. However, these limitations are not essential; as discussed above, the person of average skill will be able to apply the invention to different aperiodic or even periodic arrays, to different antenna architectures (reflectarrays, discrete lenses . . . ), to multi-beam and shaped-beam system, and to receiving antennas.

In the examples discussed above, a broadening of the field of view of an array antenna has been obtained by imposing an approximately flat radiation pattern for the individual radiating elements composing the entire array antenna. However, slightly improved results may be obtained by imposing, in the optimization, that the weighted average element pattern for the radiating elements results be approximately flat. The weighting factor of each radiating element includes the relative amplitude and phase of the field radiated by said element, and a complex array factor related to its position within the array. The weighted average element pattern may be defined as the ratio between the complex total field associated to the entire antenna (in the example considered here, constituted by 300 elements organized in 6 different subsets) and the complex array factor associated to an antenna characterized by the same number of elements (300), placed in the same positions and supposed to be isotropic radiators. Of course, this condition is satisfied when the radiation patterns of the radiating elements are themselves approximately flat. But a flat average element pattern can also be obtained by adding non-locally flat elementary radiation patterns. For example, a subset of radiating elements can show a radiation pattern with a reduction of intensity in a certain angular portion within the field of view which is compensated by another subsets of radiating elements whose radiation pattern exhibits an increase in intensity in the same angular portion.

In the examples described above, the antenna layout and the radiation patterns of the radiating elements have been optimized sequentially, i.e. a layout has been chosen a priori, and then the radiating elements have been designed to comply with it. Better results can be achieved by adopting a global optimization strategy, wherein each of the variables defining the array antenna (number, position, shape and excitation of the radiating elements) is optimized taking into account the influence of all the others. When the number of variables is high, however, this type of approach becomes cumbersome unless an iterative algorithm is used. A suitable iterative algorithm for jointly optimizing the array layout and the radiation patterns of the radiating elements comprises the following steps:

1. Defining a priori the size and shape of the aperture of the array antenna, and the maximum allowable number N of radiating elements. The size of the antenna essentially depends on the minimum beamwidth to be obtained, while the shape is often imposed by manufacturing and accommodation constraints.

2. Defining a continuous tapering that satisfies the antenna pattern requirement in terms of beamwidth and sidelobe level.

3. Designing an aperiodic array layout by replacing the continuous tapering defined at step 2 by a "density tapering", thus determining the positions and the complex excitations of the N radiating elements. See e.g. references [2, 3] (wherein the radiating elements are supposed to be identical and equi-field, or identical and fed with a stepped amplitude field tapering) or reference [4] (wherein the radiating elements are not necessarily identical to each other).

4. Determining the boundaries of the N radiating elements using a tessellation procedure like the one presented in reference [4]. This way, the entire aperture is completely filled by N cells with variable dimensions.

5. Approximating these cells, characterized by arbitrary shapes, with circular ones in such a way that contiguous cells are touching but not overlapping. This step is not essential; it simplifies the manufacturing and the optimization of the antenna, at the expense of a reduction of its directivity, as a part of the surface is not covered by the radiating elements.

6. Starting from the layout designed according to steps 3-5, optimizing the tapering of each of the N radiators, e.g. using the equation below if a "flat" radiation pattern envelope is sought:

$$\frac{J_1\left(\frac{2\pi}{\lambda}\rho\sin\theta_{EOC}\right)}{\frac{2\pi}{\lambda}\rho\sin\theta_{EOC}}\cdot\cos^q(\rho)$$

Optimization consists in determining the values of the two variable $\theta_{EOC}$ and "q", e.g. be using a quasi Newton algorithm, imposing the constraint that the pattern of every single radiator does not differ from its average value (evaluated in the antenna field of view) by more than a preset threshold, e.g. 5%, 20% or 35%. A lower threshold is used to put emphasis in a good matching between the actual radiation pattern envelope and the target one; a higher threshold is used to increase the directivity figure of the whole antenna.

Once the optimization has been done for all the N radiators, all the array parameters are known. At this point, the function representing the cumulative of the N complex tapering as a function of the position on the aperture may be evaluated. The end value of this cumulative represents exactly the total field generated by the entire array antenna in the boresight direction. This function will be used in the step 3 in the next iteration in order to determine the new N positions and complex coefficients.

7. Evaluating the error between the array antenna pattern envelope and the target angular envelope. The error can be for instance the root-mean-square (r.m.s.) error or the maximum error. The overall procedure may be iterated until the error is lower compared to a pre-assigned value or is minimized for the considered number of radiators N. If one wants to decrease further the error, the number of radiators N may be increased and the overall procedure repeated.

Steps 3 to 7 are then repeated with possible adjustment of all array design parameters in order to improve the matching with the selected angular envelope of the antenna pattern in terms of shape and/or in terms of directivity figures. In particular, in step 3, the positions and complex excitations of the N radiators are updated on the basis of the power distribution evaluated at step 6.

The invention has been described with reference to a particular example, wherein an approximately flat angular dependence of the maximum directivity of an array antenna is sought. This allows minimizing the scan losses over a nominal field of view which is broader than the minimum width of a pencil beam radiated by said antenna, which is particularly useful in geostationary satellite applications. However, the scope of the invention is not limited to this particular case: the nominal angular dependence of the maximum directivity of the array antenna can have any shape depending on the specific application considered. For example, in Low or Medium Earth Orbit applications it might be advantageous that the antenna directivity increases far from the boresight direction, up to a limit angle of the field of view, in order to compensate for the losses introduced by the longer travel of the beam and obtain uniform flux coverage on the Earth.

REFERENCES

[1] G. Toso, C. Mangenot, A. G. Roederer, "Sparse and Thinned Arrays for Multiple Beam Satellite Applications", 29th ESA Antenna Workshop on Multiple Beams and Reconfigurable Antennas, Apr. 18-20 2007.

[2] G. Toso, P. Angeletti, "Sparse and thinned array tracing," European Patent Application no. 08290154.7 filed on 18.02.2008, published on 19 Aug. 2009 with the number EP 2090995.

[3] G. Toso, P. Angeletti, "Sparse and thinned array tracing," U.S. patent application Ser. No. 12/071,519 filed on 21 Feb. 2008.

[4] M. C. Vigano', G. Toso, G. Caille, C. Mangenot. H. Lager, "Sunflower array antenna with adjustable density taper", Special Issue on Active Antennas for Satellite Applications, Hindawi International Journal of Antennas and Propagation, 2009.

[5] O. M. Bucci, M. D'Urso, T. Isernia, P. Angeletti, G. Toso, "Deterministic Synthesis of Uniform Amplitude Sparse Arrays via new Density Taper techniques", IEEE Transactions on Antennas and Propagation, June 2010.

[6] T. T. Taylor, "Design of circular apertures for narrow beam-width and low sidelobes", IEEE Transactions on Antennas and Propagation, vol. 8, 1, pp. 17-22, January 1960.

[7] X.- H. Yin et S.- C. Shi "A Simple Design Method of Multimode Horns", IEEE Transactions on Antennas and Propagation, Vol. 53, No. 1, January 2005, pages 455-459.

The invention claimed is:

1. A method for designing and manufacturing an array antenna comprising:

a design phase, comprising iteratively synthesizing by a computer an array layout of said array antenna and designing radiating elements to be arranged according to said array layout; and a phase of physically making said array antenna, comprising arranging said radiating elements according to said array layout;

wherein said design phase comprises implementing by a computer the steps of:

a) iteratively synthesizing said array layout complying with a required minimum beamwidth, a required field of view, a required side lobe level and a target angular dependence of the maximum directivity of the array antenna over said required field of view;

b) determining shaped radiation patterns of said radiating elements in order to approximate said target angular dependence of the maximum directivity of the array antenna over said required field of view; and c) designing radiating elements having the shaped radiation patterns determined at said step b).

2. The method according to claim 1, wherein said steps a) and b) of said design phase are performed jointly.

3. The method according to claim 1 wherein said step a) of said design phase comprises synthesizing an aperiodic array layout.

4. The method according to claim 3, wherein said step c) of said design phase comprises designing radiating elements having different sizes, the size of each radiating element being related to spacing from adjacent elements.

5. The method according to claim 1, wherein each of said radiating elements is chosen to belong to one among a plurality of subsets, each subset being constituted by radiating elements having a same radiation pattern, different from that of radiating elements belonging to different subsets.

6. The method according to claim 1, wherein the shaped radiation patterns determined at step b) of said design phase are such that their weighted average approximates said target angular dependence of the maximum directivity of the array antenna over said required field of view within a predetermined tolerance.

7. The method according to claim 1, wherein the shaped radiation patterns determined at said step b) of said design phase approximate said target angular dependence of the maximum directivity of the array antenna over said required field of view within a predetermined tolerance.

8. The method according to claim 1, wherein said target angular dependence of the maximum directivity of the array antenna is either flat over said required field of view, or increasing from the center towards the edges of said required field of view.

9. The method according to claim 1, wherein said step c) of said design phase comprises designing radiating elements at least some of which are sub-arrays constituted by a plurality of elementary radiating elements.

10. The method according to claim 1, wherein the design phase further comprises:

synthesizing an aperiodic array layout;

designing a plurality of radiating elements, wherein the plurality of radiating elements are fed with an aperture excitation with both amplitude and phase tapering, wherein said radiating elements are arranged according to said aperiodic array layout, and, wherein said radiating elements are designed during said design phase and physically made during said phase of physically making said array antenna so that said radiating elements have different sizes, the size of each radiating element being related to spacing from nearby elements, wherein said radiating elements have shaped radiation patterns whose weighted average is:

either flat within 35% or less over said required field of view;

or increasing from the center towards the edges of said required field of view;

said required field of view having a width of at least 5 times a minimum beamwidth determined by said array layout.

11. The method according to claim 10, wherein said radiating elements have shaped radiation patterns which are themselves:

either flat within 35% or less over said required field of view;

or increasing from the center towards the edges of said required field of view.

12. The method according to claim 10, wherein said plurality of radiating elements are adapted to be fed by a beam forming network with an aperture excitation with both amplitude and phase tapering, said beam forming network being adapted for:

either scanning at least one beam over said required field of view;

or generating a plurality of beam pointing at different directions of said required field of view;

or generating a shaped beam covering said required field of view.

13. The method according to claim 10, wherein each of said radiating elements belongs to one among a plurality of subsets, each subset being constituted by radiating elements having a same radiation pattern, different from that of radiating elements belonging to different subsets.

14. The method according to claim 10, wherein said aperiodic array layout forms a sunflower lattice.

15. The method according to claim 10, wherein at least some of said radiating elements are sub-arrays constituted by a plurality of elementary radiating elements.

* * * * *